US007824232B2

(12) United States Patent
Daly et al.

(10) Patent No.: US 7,824,232 B2
(45) Date of Patent: Nov. 2, 2010

(54) MULTI-POSITION MIXED-CONTACT CONNECTOR WITH SEPARABLE MODULAR RJ-45 COUPLER

(75) Inventors: Peter R. Daly, Yorktown Heights, NY (US); Christopher J. Poulin, Carmel, NY (US)

(73) Assignee: BTX Technologies, Inc., Hawthorne, NY (US)

( * ) Notice: Subject to any disclaimer, the term of this patent is extended or adjusted under 35 U.S.C. 154(b) by 0 days.

(21) Appl. No.: 12/356,281

(22) Filed: Jan. 20, 2009

(65) Prior Publication Data

US 2009/0186493 A1 Jul. 23, 2009

Related U.S. Application Data

(60) Provisional application No. 61/022,089, filed on Jan. 18, 2008.

(51) Int. Cl.
*H01R 24/00* (2006.01)

(52) U.S. Cl. ..... 439/676; 439/638

(58) Field of Classification Search ..... 439/676, 439/66, 941, 628, 638
See application file for complete search history.

(56) References Cited

U.S. PATENT DOCUMENTS 4,153,327 A * 5/1979 Johnson ..... 439/344
4,273,402 A * 6/1981 Hughes ..... 439/344
4,593,966 A * 6/1986 Meyer ..... 439/595
4,698,025 A * 10/1987 Silbernagel et al. ..... 439/79
4,806,117 A * 2/1989 Johnston ..... 439/344
4,817,283 A * 4/1989 Johnston et al. ..... 29/884
5,674,093 A * 10/1997 Vaden ..... 439/676
5,735,714 A * 4/1998 Orlando et al. ..... 439/676
5,779,503 A * 7/1998 Tremblay et al. ..... 439/676
6,123,564 A * 9/2000 Belmore, III ..... 439/344
6,336,830 B1 * 1/2002 Lee ..... 439/676
6,383,028 B1 * 5/2002 Chang ..... 439/638
6,416,364 B1 * 7/2002 Shi et al. ..... 439/680
6,428,362 B1 * 8/2002 Phommachanh ..... 439/676
6,964,585 B2 * 11/2005 Blichasz et al. ..... 439/638
6,988,914 B2 * 1/2006 Pepe et al. ..... 439/638
7,125,288 B2 * 10/2006 Schilling ..... 439/676
7,131,872 B1 * 11/2006 Lee et al. ..... 439/677
2001/0021608 A1 * 9/2001 Borbolla et al. ..... 439/676
2002/0009930 A1 * 1/2002 Chang ..... 439/677
2003/0129880 A1 * 7/2003 Arnett et al. ..... 439/676

* cited by examiner

*Primary Examiner*—Neil Abrams
*Assistant Examiner*—Harshad C Patel
(74) *Attorney, Agent, or Firm*—Leason Ellis LLP

(57) ABSTRACT

A connector system includes a first connector part including at least one first cavity formed therein. The first connector part has at least one first contact. The system includes a second connector part including at least one second cavity formed therein. The second connector part is complementary to the first connector part such that when the first and second connector parts mate together. The first and second cavities are at least partially aligned and the first and second contacts are placed in electrical contact with one another. The system also includes a printed circuit board sub-assembly including a printed circuit board, a plurality of spring contacts that are electrically coupled to the printed circuit board. The sub-assembly has a stabilizing element that includes a plurality of vanes with the spring contacts being disposed between the vanes. The sub-assembly is securely disposed within the first connector part such that the spring contacts are accessible along both a front surface thereof and along an opposite second surface thereof.

17 Claims, 6 Drawing Sheets

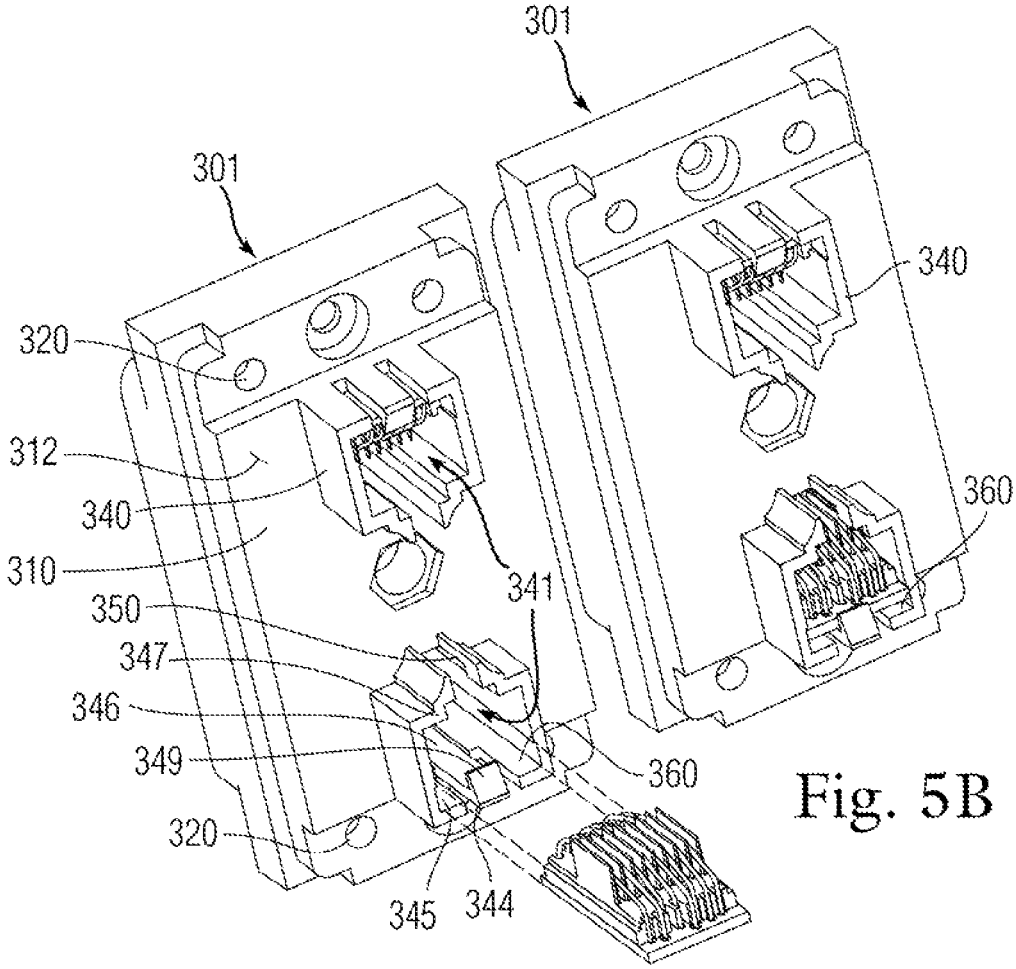
Fig. 5B
Fig. 5A
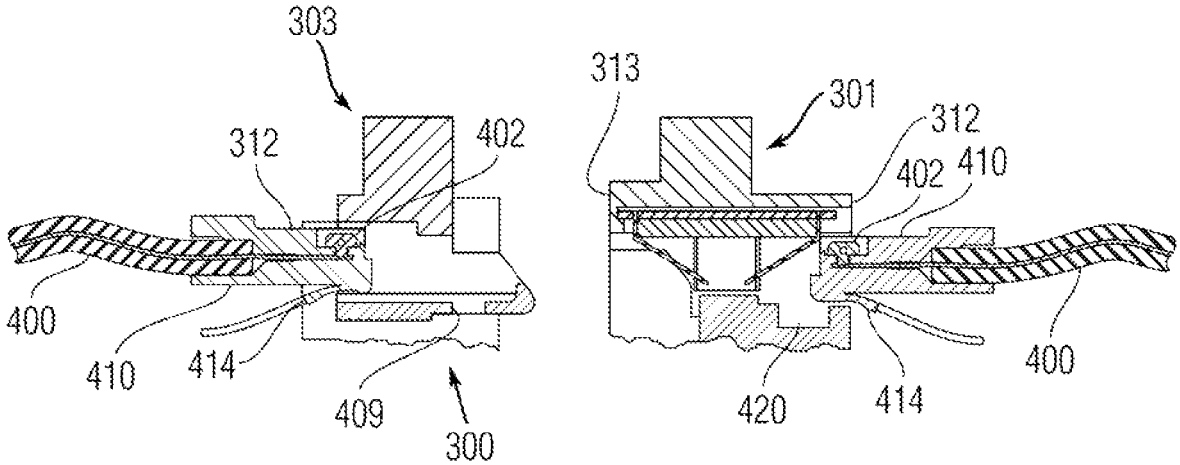
Fig. 6

MULTI-POSITION MIXED-CONTACT CONNECTOR WITH SEPARABLE MODULAR RJ-45 COUPLER

CROSS REFERENCE TO RELATED APPLICATION

The present application claims the benefit of U.S. patent application Ser. No. 61/022,089, filed Jan. 18, 2008, which is hereby incorporated by reference in its entirety.

TECHNICAL FIELD

The present invention relates generally to an electrical connector that possesses more than one type of electrical contact and more particularly, an electrical connector that possesses a separable 8 position modular coupler (female to female RJ-45 jacks) suitable for passing Ethernet transmissions along with coaxial and discreet transmission lines. Further, the electrical connector can be used in combination with a hood and cable assembly for electrically connecting multiple devices with a single connector where several connectors are usually required.

BACKGROUND

In many industries such as Audio Visual, Broadcasting, Multi-Media and many others, electronic systems have multiple components with multiple connection points and many different connector interfaces. This becomes cumbersome, complex and confusing when trying to connect these systems together. It is especially problematic when these systems are of a temporary nature such as in an auditorium, conference room or classroom application where these multiple connections must be engaged and disengaged frequently. In many of these applications, the end-user is not an electronic technician and can easily incorrectly connect or fail to connect critical components to the system.

The present invention provides a method for consolidating the multitudes of different signal types and connection types into a single connector. This includes coaxial connectors for 75 ohm transmission lines, discreet contacts for audio, power, control and other ancillary signals and most importantly, separable 8 position modular couplers, also known as RJ-45 jacks, for passing Ethernet network signals.

While there are other mixed contact connectors on the market, the need for Ethernet network connections in these connector systems has gone unaddressed. In order to maintain proper signal integrity, discreet signal contacts cannot always be used for Ethernet transmission depending upon the speed of the Ethernet connection. The standard connector for Ethernet network connections is the modular 8 position RJ-45 jack and plug. Modular RJ-45 connectors provide correct conductor spacing and have electrical compensation features that allow critical electrical parameters, such as, impedance, near-end crosstalk (NEXT) and far-end crosstalk (FEXT) to remain within acceptable levels. In order to integrate the features of the modular RJ-45 connector into a multi-position, mixed-contact connector and further, to allow the connection to the modular RJ-45 coupler using standard Ethernet cables pre-terminated with RJ-45 plugs, it was necessary to develop a modular RJ-45 coupler that can be separated when each half of the connector system was disengaged but without having to remove the individual mating modular 8 position RJ-45 plugs.

SUMMARY

The present invention incorporates a printed circuit board with spring contacts on each end and vanes to maintain proper alignment of the spring contacts to allow an Ethernet or other signal that can utilize modular 8 position RJ-45 connectors to be carried from one side to the other. This assembly fits neatly into a cavity on one half of the connector system designed specifically for this purpose. The cavity includes a snap lock to secure the printed circuit sub-assembly in place. This cavity also includes a catch that facilitates locking the mating modular RJ-45 plug into place just as it would standardly work with regular modular 8 position RJ-45 jacks.

The other half of the connector system furnishes a cavity with a locking catch that facilitates the locking in of the opposing modular RJ-45 plug. The positioning of the secured modular RJ-45 plug is such that it is exposed on the mating surface in this half of the connector system so that when the two halves are mated, the modular RJ-45 plug will engage with the spring contacts on the printed circuit board sub-assembly in the other half.

This provides the installer of these systems with a method to connect Ethernet connections along with 75 ohm video signals and other signals utilizing discreet contacts. The separable modular 8 position coupler can also be used for other signals that utilize modular 8 position RJ-45 connectors, such as Video Baluns. Further, the installer can use off the shelf pre-terminated Ethernet cables to accomplish their tasks which is a huge time-saver in field installation. This allows the Ethernet cables to be purchased pre-made, field terminated or made in optimal work-shop conditions rather than on-site.

BRIEF DESCRIPTION OF THE DRAWING FIGURES

FIG. 5A is a perspective view of one half of the connector system just prior to the printed circuit sub-assembly, shown exploded therefrom, is inserted into place, wherein the coaxial and discreet contacts are not shown;

FIG. 5B is a perspective view of one half of the connector system just after the printed circuit sub-assembly is inserted into place, with the coaxial and discreet contacts not being shown;

FIG. 6 is a cross-sectional view of a portion of both halves of the connector system where the Ethernet connections reside just prior to Ethernet cables terminated with modular 8 position RJ-45 plugs being engaged;

FIG. 7 is a cross-sectional view of just a portion of both halves of the connector system where the Ethernet connections reside with the Ethernet cables terminated with modular 8 position RJ-45 plugs partially engaged, wherein FIG. 7 shows the locking tabs on the modular 8 position RJ-45 plugs being depressed prior full engagement when they will lock in place;

DETAILED DESCRIPTION OF PREFERRED EMBODIMENTS

Figure 1:
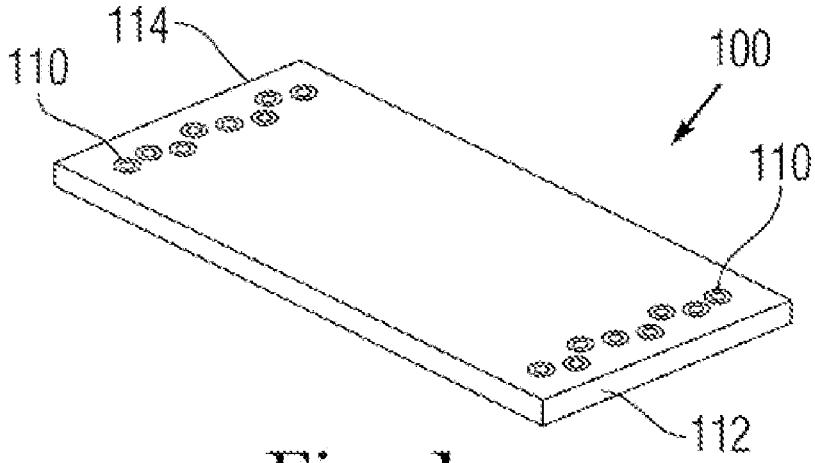
FIG. 1 is a perspective view of a printed circuit board prior to assembly.

FIG. 1 is a perspective view of a printed circuit board 100. The printed circuit board 100 can be a conventional circuit board that includes a plurality of openings 110. The openings 110 are arranged in two sets, one set formed along one edge 112 of the circuit board 100 and the other set being formed along one edge 114 of the circuit board 110. The openings 110 can be staggered as shown. The openings 110 are arranged in pairs, with one opening of the pair formed in one set and the other opening of the pair formed in the other set of openings.

Figure 2:
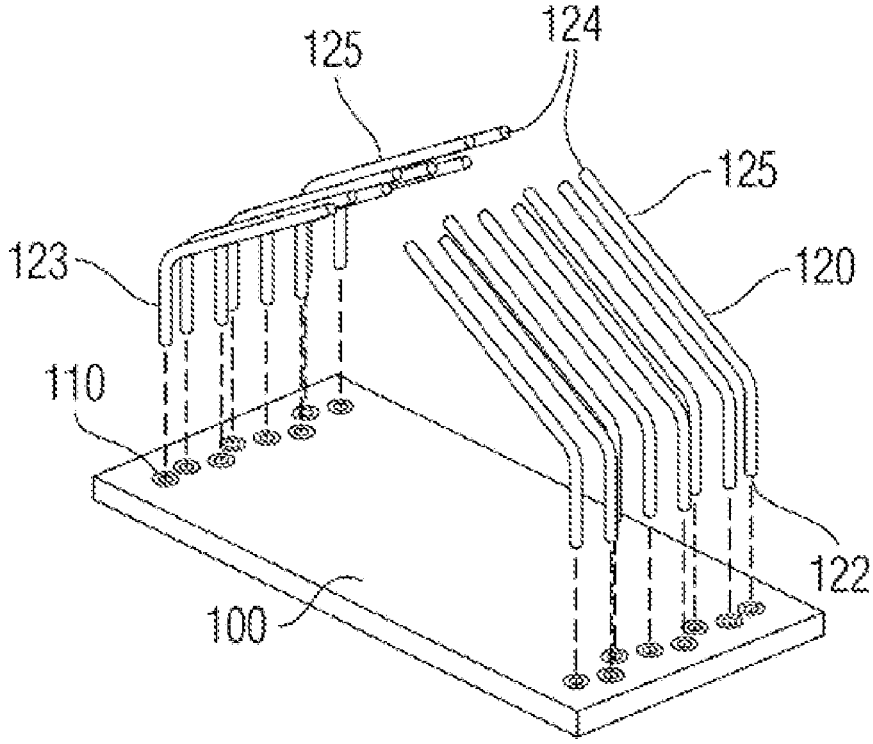
FIG. 2 is an exploded perspective view of the printed circuit board with spring contacts being shown exploded therefrom.

FIG. 2 is a perspective view of the printed circuit board 100 with a plurality of spring contacts 120 being shown exploded therefrom. Each spring contact 120 has a first end 122 that is received within the opening 110 while the other second end 124 is spaced from the circuit board 100. As shown, the spring contact 120 has a bent construction with a first vertical section 123 that terminates in first end 122 and when received within the opening 110, the first section 123 extends upright (perpendicular) to the upper surface of the circuit board 100. A second section 125 is a bent (angled) section relative to the first section 123.

Figure 3:
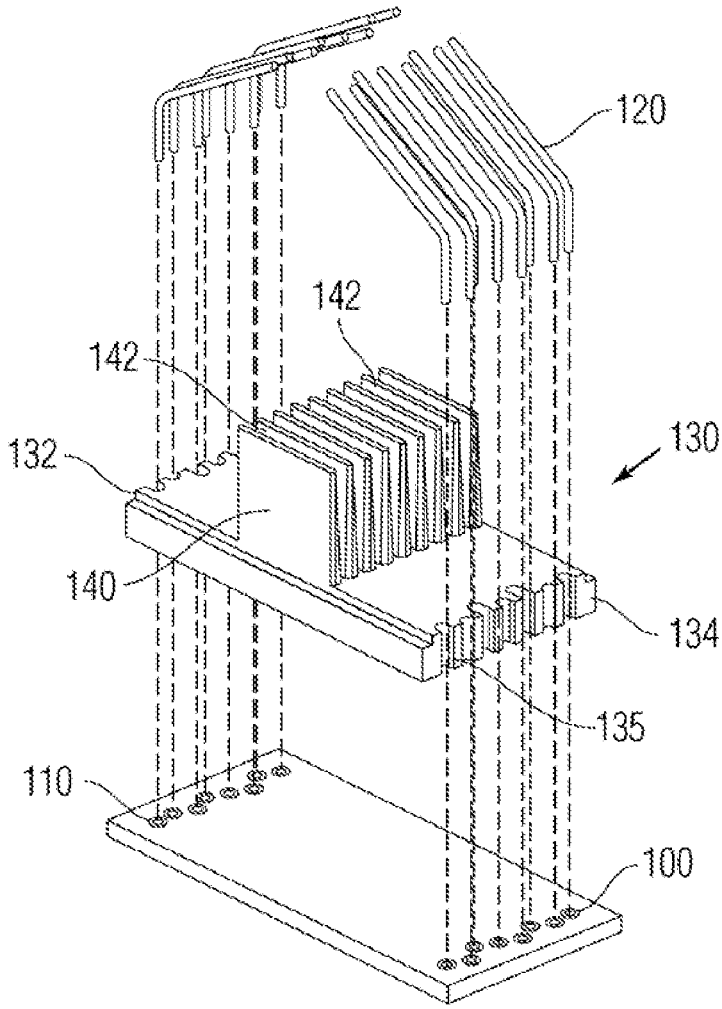
FIG. 3 is an exploded perspective view of the printed circuit board showing where the spring contacts will be placed as well as where stabilizing alignment vanes are to be placed.

FIG. 3 is an exploded perspective view of the spring contacts 120 and the circuit board 100 along with a stabilizing member 130. The stabilizing member 130 is a block structure that has a first end 132 and an opposing second end 134. The stabilizing member 130 also includes a plurality of vanes 140 that are spaced across and extend upwardly from an upper surface of the stabilizing member 130. The vanes 140 are fin-like structures that are spaced apart across the width of the stabilizing member 130 so as to define slots 142 between the vanes 140. Each of the ends 132, 134 includes a channel or slot 135 that received the first section 123 of the spring contact 120. The slots 135 are formed so that when the stabilizing member 130 is disposed on the printed circuit board 100, the slots 135 are aligned with (in registration) the openings 110 formed in the circuit board 100.

Figure 4:
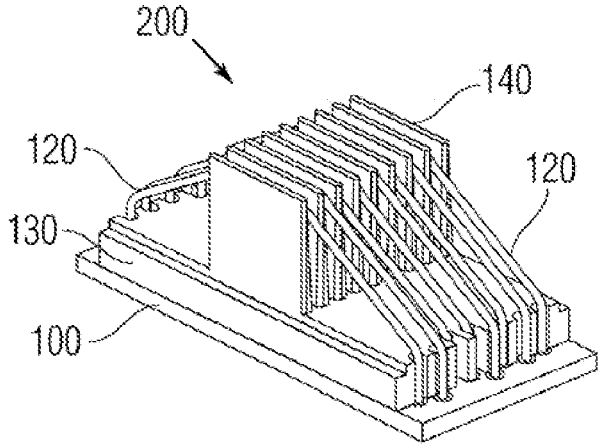
FIG. 4 is a perspective view of the completed printed circuit board sub-assembly.

As shown in FIG. 4, the spring contacts 120 are disposed within the openings 110 and the second sections 125, including the second ends 124, are disposed between the vanes 140. Each pair of spring contacts 120 face one another with the second ends 124 are being proximate one another between two upstanding, spaced vanes 140. The vanes 140 act as a stabilizing structure in that the spring contacts 120 are held in place between the vanes 140. FIG. 4 is a perspective view of a completed printed circuit board sub-assembly 200.

As shown in the figures, (e.g., FIG. 6), a connector assembly 300 that is complementary to and receives the sub-assemblies 200, is actually formed of two parts, namely a first part 301 and a second part 303 that mate together to form the assembled connector assembly 300.

FIG. 5A is a perspective view of one half (first part 301) of the connector system 300 prior to the printed circuit board sub-assembly 200 being inserted into place. The first connector part 301 has a body 310 that includes features 320 that permit the body 310 to be mounted to a surface, such as a wall. For example, the features 320 can be in the form of openings 320 though which fasteners can be received for securely attaching the body 310 to the mounting surface.

The body 310 includes a pair of connector openings or slots into which the printed circuit board sub-assembly 200 is received. In particular, one face 312 of the body 310 includes a pair of projections 340 that extend outwardly therefrom and define the openings 320. The projections 340 extend perpendicularly outward from the face 312. The projections 340 are symmetric to one another and in particular, are mirror images. Each projection 340 defines a cavity 341 into which the printed circuit board sub-assembly 200 is received. The projection 340 includes a first wall 345 that has a pair of slots 344 that define a flexible release finger 346. The distal end of the finger 346 has a catch 349 for releasably locking the printed circuit board sub-assembly 200 in place.

An opposite second wall 347 of the projection 340 has slot 350 formed therein. The slot 350 is axially aligned with the finger 346 but is located across the cavity 341. In the illustrated embodiment, the cavity 341 has a square shape. The wall 345 has a floor 360 defined on either side of the finger 346 which acts as a support surface for the sub-assembly 200 and in particular, for the printed circuit board 100 thereof. The opposite second wall 347 has a stepped construction surrounding the slot 350.

Figure 11:
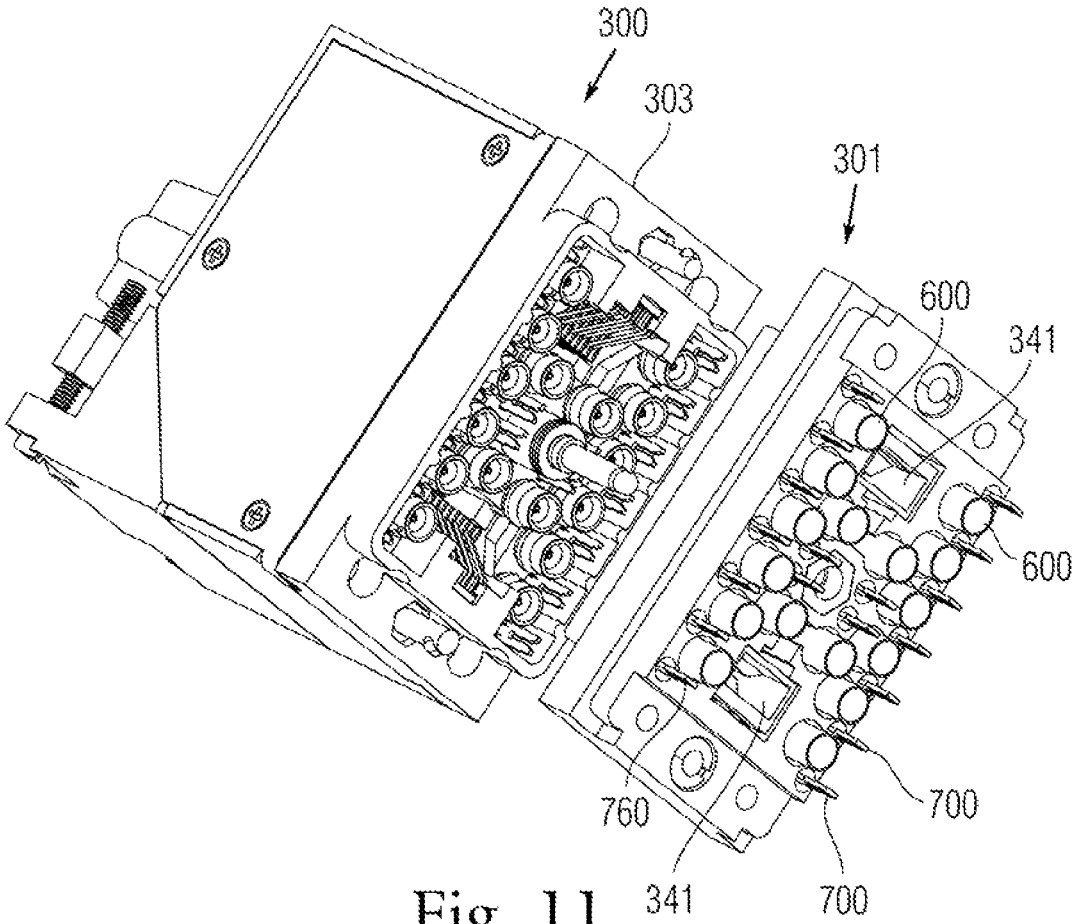
FIG. 11 is a perspective view of both halves of the connector system with the separable modular X position RJ-45 coupler, coaxial contacts and discreet contacts.
Figure 12:
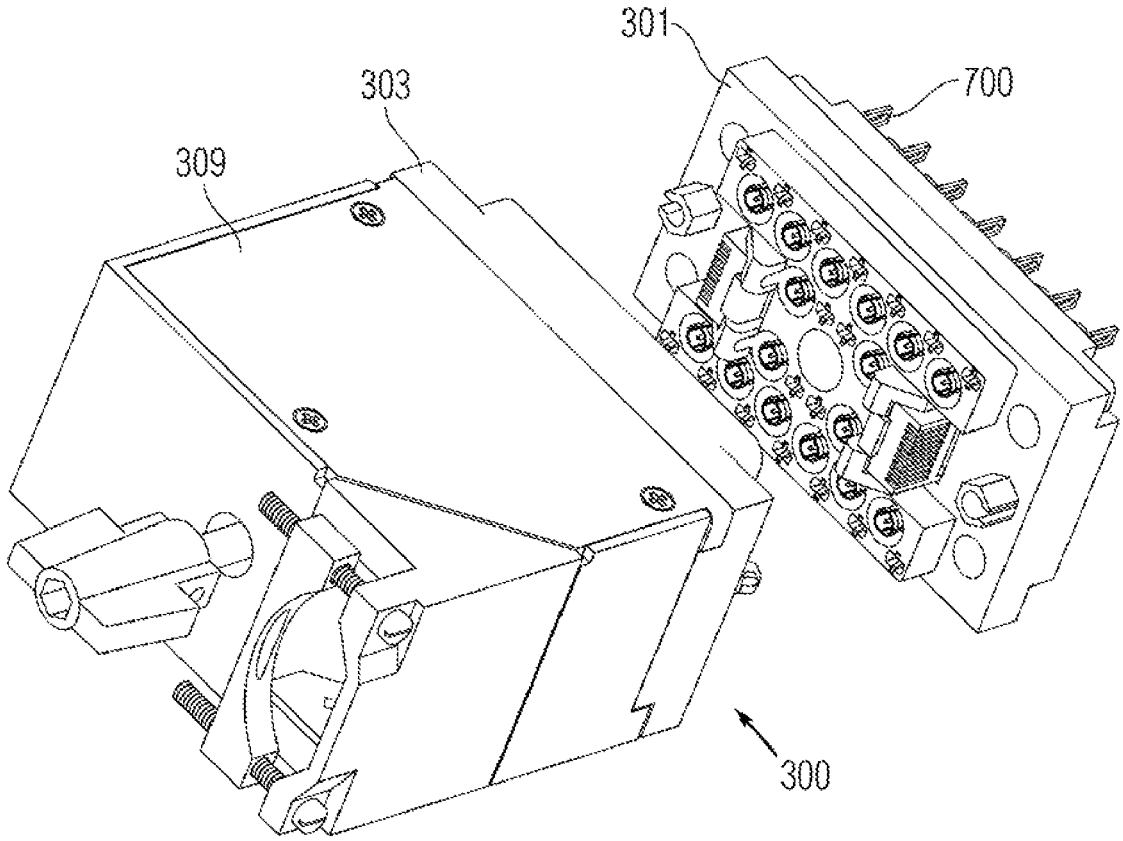
FIG. 12 is an opposite perspective view of FIG. 11.

It will be appreciated that in FIG. 5A, the printed circuit board sub-assembly 200 is shown without all of the spring contacts 120 for clarity's sake and in particular, the coaxial and discreet spring contacts 120 that form a part of the sub-assembly 200 are not shown. FIGS. 11 and 12 show these contacts.

FIG. 5B is a perspective view of one half (first part 301) of the connector system 300 after the printed circuit board sub-assembly 200 is inserted into the cavity 341. One end of the sub-assembly 200 is inserted into the cavity 341 with the printed circuit board 100 facing the first wall 345. Since the finger 346 is flexible, as the sub-assembly 200 is inserted, the printed circuit board 100 causes a downward flexing of the finger 346 to permit full reception of the sub-assembly 200. The finger 346 flexes out of the plane until the catch 349 clears the printed circuit board 100 and is biased upwardly into an engagement position with the end of the printed circuit board 100. The catch 349 thus engages and locks the sub-assembly 200 in place within the cavity 341. In the locked position of FIG. 5B, the top exposed edges of the vanes 140 face the second wall 347 and the printed circuit board 100 sits on the edges (floor) that are on either side of the finger 346.

Since the body 310 has a symmetric design, when the two sub-assemblies 200 are inserted into the two cavities 341 of the projections 340, the contacts 120 face one another with the two slots 350 being spaced from one another but in facing relationship. FIG. 5B shows the two sub-assemblies 200 being inserted into the cavities 341 and locked in place.

The cavities 341 are defined as through holes as shown in the figures, (e.g., FIG. 6) in that when the sub-assembly 200 is inserted into and locked in place in the cavity 341, both sets of spring contacts 120 are accessible. One set of the spring contacts 120 is accessible along the face 312, while the other set of contacts 120 is accessible along the opposite face 313. In this manner and as described below, two connectors can be inserted into faces 312, 313 of the body 310 to form an electrical connection with the two sets of spring contacts 120.

In accordance with the present invention, the connector assembly 300 is designed to provide Ethernet network connections.

In particular, FIG. 6 shows an Ethernet cable 400 that terminates with a plug 410 that is constructed to mate with the spring contacts 120. In one embodiment, the plug 410 is a modular 8 position RJ-45 plug. The plug 410 includes a body 412 that provides contacts 402 for electrically connection to the cable 400. The plug 410 also includes a flexible locking tab 414 for releasably locking the plug 410 in place within the cavity 341 and in locked electrical connection with the sub-assembly 200. The locking tab 414 is a flexible finger that is constructed to mate with a locking catch 420 that is formed as part of the body 310. As shown in FIG. 6, the plug 410 is inserted such that the locking tab 414 and catch 420 are located in a surface opposite the surface from which the spring contacts 120 extend. FIG. 6 shows both halves of the connector system.

Figure 7:
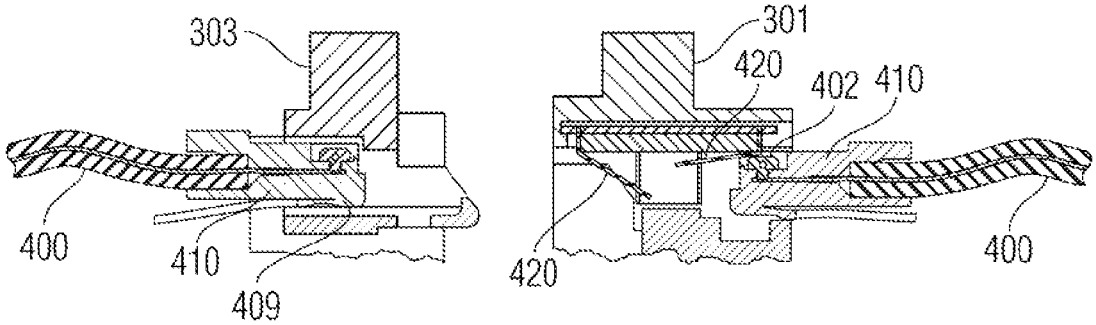

FIG. 7 is a cross-sectional view of a portion of both halves 301, 303 of the connector system where the Ethernet connections reside with the Ethernet cables 400 terminated with modular 8 position RJ-45 plugs being partially engaged. FIG. 7 shows the locking tabs 414 on the modular 8 position RJ-45 plugs 410 being depressed prior to full engagement when the locking tabs 414 lock in place.

Figure 8:
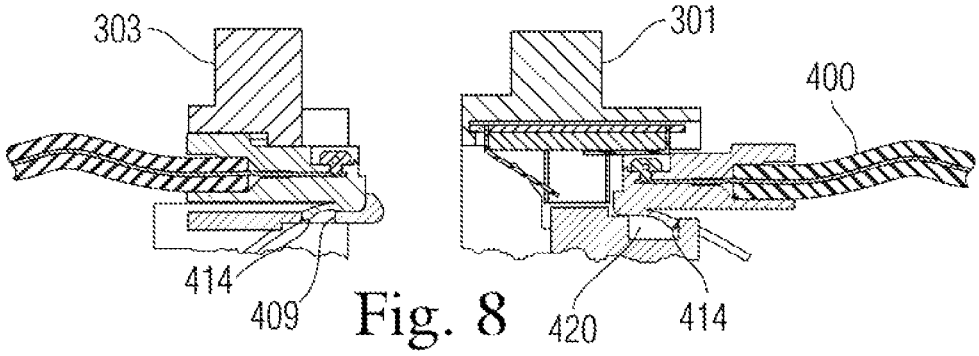
FIG. 8 is a cross-sectional view of just a portion of both halves of the connector system where the Ethernet connections reside with the Ethernet cables terminated with modular 8 position RJ-45 plugs fully engaged, wherein the locking tabs on the modular 8 position RJ-45 plugs snapped into place locking the connector in position.

FIG. 8 is a cross-sectional view of a portion of both halves of the connector system where the Ethernet connections reside with the Ethernet cables 400 terminated with modular 8 position RJ-45 plugs being fully engaged. FIG. 8 shows the locking tabs 414 on the modular 8 position RJ-45 plugs 410 snapped into place locking the connector in position.

Figure 9:
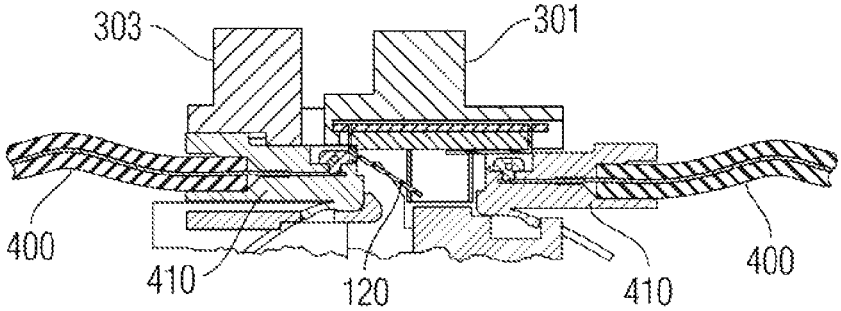
FIG. 9 is a cross-sectional view of just a portion of both halves of the connector system where the Ethernet connections reside with the Ethernet cables terminated with modular 8 position RJ-45 plugs fully engaged just prior to the connector system being engaged.

FIG. 9 is a cross-sectional view of both halves 301, 303 of the connector system where the Ethernet connections reside with the Ethernet cables 400 terminated with modular 8 position RJ-45 plugs being fully engaged just prior to the connector system being engaged.

Figure 10:
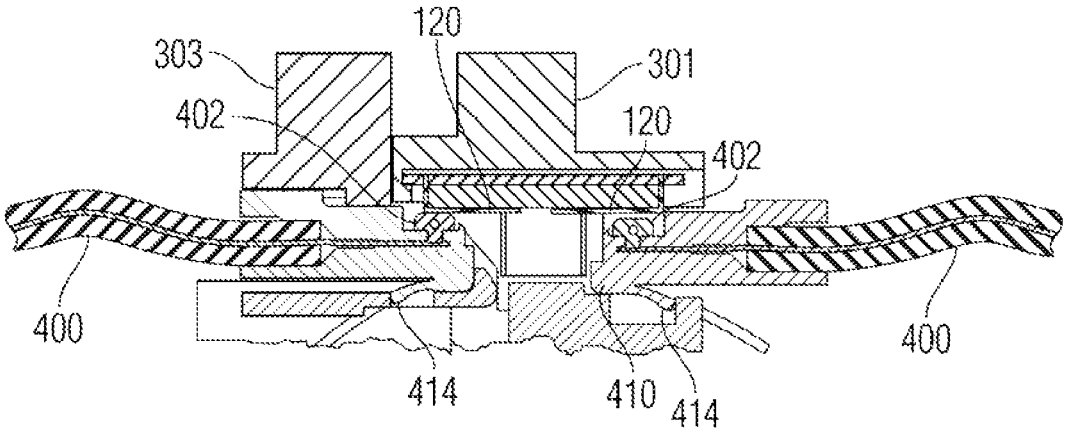
FIG. 10 is a cross-sectional view of just a portion of both halves of the connector system where the Ethernet connections reside with the Ethernet cables terminated with modular 8 position RJ-45 plugs fully engaged and both halves of the connector system fully engaged.

FIG. 10 is a cross-sectional view of both halves 301, 303 of the connector system where the Ethernet connections reside with the Ethernet cables 400 terminated with modular 8 position RJ-45 plugs being fully engaged and both halves 301, 303 of the connector system 300 being fully engaged.

As can be seen from the figures, each of the first and second connector parts 301, 303 include openings or slots that receive Ethernet cables 400 terminated with modular 8 position RJ-45 plugs 410.

It will therefore be appreciated that the two Ethernet cables 400 are in electrical contact with the two sets of spring contacts 120, with the contacts 402 of one Ethernet connector being placed in electrical contact with spring contacts of one set of spring contacts, while the contact 402 of the other Ethernet connector is placed in electrical contact with spring contacts of the other set of spring contacts. This electrical connection results when the two connector parts 301, 303 are placed into the engaged, locked position shown.

FIG. 11 is a perspective view of both halves (first and second connector parts 301, 303) of the connector assembly 300 with the separable modular 8 position RJ-45 coupler, coaxial contacts and discreet contacts.

FIG. 12 is another perspective view of both halves (first and second connector parts 301, 303) of the connector assembly 300 showing the various contacts thereof.

The part 305 includes a housing or hood 309 that attaches to the part 303.

The present invention thus incorporates the printed circuit board 100 with spring contacts 120 on each end and vanes 140 to maintain proper alignment of the spring contacts 120 to allow an Ethernet or other signal that can utilize modular 8 position RJ-45 connectors (plugs 410) to be carried from one side to the other. This assembly fits neatly into the cavity 341 on one half (part 301) of the connector system designed specifically for this purpose. The cavity 341 includes a snap lock (catch 349) to secure the printed circuit sub-assembly in place. This cavity 341 also includes a catch 420 that facilitates locking the mating modular RJ-45 plug 410 into place.

The other half (part 303) of the connector system 300 furnishes a cavity with a locking catch 409 that facilitates the locking in of the opposing modular RJ-45 plug 410. The positioning of the secured modular RJ-45 plug is such that it is exposed on the mating surface in this half of the connector system so that when the two halves are mated, the modular RJ-45 plug 410 will engage with the spring contacts 120 on the printed circuit board sub-assembly 200 in the other half (part 301).

This provides the installer of these systems with a method to connect Ethernet connections along with 75 ohm video signals and other signals utilizing discreet contacts. The separable modular 8 position coupler can also be used for other signals that utilize modular 8 position RJ-45 connectors, such as Video Baluns. Further, the installer can use off the shelf pre-terminated Ethernet cables to accomplish their tasks which is a huge time-saver in field installation. This allows the Ethernet cables to be purchased pre-made, field terminated or made in optimal work-shop conditions rather than on-site.

It will be appreciated that the present invention is not limited to the disclosed connector system but rather it can be incorporated in other configurations in other connector systems and in different multiples. Further, the present invention can work for other modular RJ type connectors such as the 4 and 6 position versions commonly associated with telephone service. The current embodiment incorporates two separable 8 position modular couplers along with fourteen 75 ohm coaxial contacts 600 and eighteen discreet contacts 700. However, the present invention can be designed into just about any connector system that provides enough space and proper alignment. When the two parts 301, 303 mate together, the contacts 600, 700 are also placed in electrical connection with one another.

It will be appreciated by persons skilled in the art that the present invention is not limited to the embodiments described thus far with reference to the accompanying drawings; rather the present invention is limited only by the following claims.

The invention claimed is:

1. A connector system comprising:

a first connector part including a first separable modular 8 position RJ-45 coupler; and a second connector part including a second separable modular position RJ-45 coupler, wherein the first and second connector parts mate together and the first and second couplers are placed into electrical contact with a contact that is associated with the first connector part;

wherein the modular 8 position RJ-45 coupler comprises a printed circuit board subassembly separate from both the first and second connector parts, the sub-assembly including a plurality of contacts arranged so that a first set thereof is accessible and engageable along a front surface of the first connector part and a second set thereof is accessible and engageable along an opposite second surface of the first connector part, thereby allowing insertion of a complementary connector member in a first direction into contact with the first set of contacts or insertion of the complementary connector member in an opposite second direction into contact with the second set of contacts; and wherein the subassembly having a stabilizing element that includes a plurality of vanes with the contacts being disposed between the vanes, the sub-assembly being securely disposed within the first connector part such that the contacts are accessible along both a front surface thereof and along an opposite second surface thereof.

2. The connector system of claim 1, wherein the first and second sets of opposing spring contacts are arranged in pairs, each pair being disposed between adjacent vanes, each end of the stabilizing element having locating notches formed at ends thereof in which the spring contacts are inserted.

3. The connector system of claim 2, wherein the first connector part includes a first cavity that extends completely through the first connector part, with the first set of spring contacts being accessible at one entrance to the cavity along the first surface of the first connector part and the second set of spring contacts being accessible along an opposite entrance to the cavity along the second surface of the first connector part.

4. The connector system of claim 1, wherein the complementary connector member comprises a pre-terminated Ethernet network cable terminated with a modular plug.

5. The connector system of claim 4, wherein the plug is a modular 8 position RJ-45 plug.

6. A connector system comprising:

a first connector part including at least one first cavity formed therein, the first connector part having at least one first contact;

a second connector part including at least one second cavity formed therein, second connector part being complementary to the first connector part such that when the first and second connector parts mate together, the first and second cavities are at least partially aligned and the first and second contacts are placed in electrical contact with one another; and a printed circuit board sub-assembly including a printed circuit board, a plurality of spring contacts that are electrically coupled to the printed circuit board, the sub-assembly having a stabilizing element that includes a plurality of vanes with the spring contacts being disposed between the vanes, the sub-assembly being securely disposed within the first connector part such that the spring contacts are accessible along both a front surface thereof and along an opposite second surface thereof.

7. The connector system of claim 6, wherein the first connector part includes a flexible finger that is in communication with the first cavity and has a catch at a free end that interlockingly engages the printed circuit board to cause the sub-assembly to be securely locked in place within the first cavity.

8. The connector system of claim 6, wherein there are two sets of opposing spring contacts arranged in pairs, each pair being disposed between adjacent vanes, each end of the stabilizing element having locating notches formed at ends thereof in which the spring contacts are inserted.

9. The connector system of claim 8, wherein the first cavity extends completely through the first connector part, with one set of spring contacts being accessible along the first side and the other set of spring contacts being accessible along the second side.

10. The connector system of claim 8, further including pre-terminated Ethernet network cables terminated with modular plugs, one cable plug being received and interlockingly secured within the first cavity, one cable plug being received and interlockingly secured within the second cavity, each plug having contacts that are placed in electrical contact with the corresponding set of contacts of the sub-assembly.

11. The connector system of claim 10, wherein the plugs are modular 8 position RJ-45 plugs.

12. The connector system of claim 6, wherein the first and second contacts are selected from a group consisting of 75 ohm coaxial contacts and discreet signal contacts.

13. A connector system comprising:

a first connector part including at least one first cavity formed therein, the first connector part having at least one first contact;

a second connector part including at least one second cavity formed therein, the second connector part being complementary to the first connector part such that when the first and second connector parts mate together, the first and second cavities are at least partially aligned and the first and second contacts are placed in electrical contact with one another; and a printed circuit board sub-assembly including a printed circuit board, a plurality of spring contacts that are electrically coupled to the printed circuit board and are electrically coupled to the first and second contacts, the sub-assembly having a stabilizing element that includes a plurality of vanes with the spring contacts being disposed between the vanes.

14. The connector system of claim 13, wherein there are two sets of opposing spring contacts arranged in pairs, each pair being disposed between adjacent vanes, each end of the stabilizing element having locating notches formed at ends thereof in which the spring contacts are inserted.

15. The connector system of claim 14, wherein the first cavity extends completely through the first connector part, with one set of spring contacts being accessible along a first side of printed circuit board and the other set of spring contacts being accessible along a second side of printed circuit board.

16. The connector system of claim 14, further including pre-terminated Ethernet network cables terminated with modular plugs, one cable plug being received and interlockingly secured within the first cavity, one cable plug being received and interlockingly secured within the second cavity, each plug having contacts that are placed in electrical contact with the corresponding set of contacts of the sub-assembly.

17. The connector system of claim 16, wherein the plugs are modular 8 position RJ-45 plugs.

* * * * *